US006272303B1

(12) United States Patent
Takeda

(10) Patent No.: US 6,272,303 B1
(45) Date of Patent: Aug. 7, 2001

(54) CHARGING DEVICE FOR ELECTROPHOTOGRAPHY

(75) Inventor: Kazuhisa Takeda, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/604,373

(22) Filed: Jun. 27, 2000

(30) Foreign Application Priority Data

Jun. 28, 1999 (JP) ..... 11-181921

(51) Int. Cl.[7] ..... G03G 15/02
(52) U.S. Cl. ..... 399/175; 399/100
(58) Field of Search ..... 399/175, 174, 399/100, 111, 349, 353; 361/221

(56) References Cited

U.S. PATENT DOCUMENTS 5,455,661 * 10/1995 Yoshida et al. ..... 399/175
5,606,401 * 2/1997 Yano ..... 399/175
5,633,701 * 5/1997 Yoshida ..... 399/175

FOREIGN PATENT DOCUMENTS 7-128951 5/1995 (JP) .

* cited by examiner

*Primary Examiner*—Sophia S. Chen
(74) *Attorney, Agent, or Firm*—Frishauf, Holtz, Goodman, Langer & Chick, P.C.

(57) ABSTRACT

A charging device for electrophotography includes a charging brush, having many fibers extending in radial around a rotation shaft and contacted with a surface of a photosensitive drum, for rotating to electrically charge the surface of the photosensitive drum with the fibers, and a charging control member located on a downstream side of a contact between the charging brush and the photosensitive drum in a rotation direction of the charging brush for temporarily retarding a movement of the fibers of the charging brush to increase an effective density of the fibers to be contacted with the surface of the photosensitive drum. Particularly, an end of the charging control member is at a distance of at least 1 mm from the contact between the charging brush and the photosensitive drum.

17 Claims, 3 Drawing Sheets

CHARGING DEVICE FOR ELECTROPHOTOGRAPHY

CROSS-REFERENCE TO RELATED APPLICATIONS

This application is based upon and claims the benefit of priority from the prior Japanese Patent Application No. 11-181921, filed Jun. 28, 1999, the entire contents of which are incorporated herein by reference.

BACKGROUND OF THE INVENTION

The present invention relates to an electrophotographic apparatus represented by, for example, a laser printer and, in particular, to a charging device for electrophotographic which electrically charges a recording sheet.

In the electrophotographic apparatus, a reversal development method has been widely adopted as well known in the art. This reversal development method has steps of electrically charging a surface of a photosensitive drum, selectively canceling the charge on the surface of the photosensitive drum by a laser beam to form an electrostatic latent image (negative latent image), and supplying toner particles to the surface of the photosensitive drum to develop the latent image into a toner image. The toner particles are charged with the same polarity as that of the photosensitive drum on a development roller and supplied to the surface of the photosensitive drum. The toner image is formed of toner particles adhered to no charge or less charge area of the charged surface. The development roller is directly contacted with the photosensitive drum to increase the strength of an electric field between the development roller and the no charge or less charge area of the charged surface of the photosensitive drum.

In addition, to electrically charge the surface of the photosensitive drum, a method of bringing a charging brush into contact with the surface of the photosensitive drum is widely used.

A typical electrophotographic apparatus comprises, as shown for example in FIG. 1, a photosensitive drum 31, charging brush 34, cleaning blade 35, and developing section 38. The developing section 38 includes a supply roller 42 and a developing roller 43. The charging brush 34 is arranged parallel to the shaft of the photosensitive drum 31 and set to be in contact with the surface of the photosensitive drum 31. The charging brush 34 is formed in a roller-shape by attaching many conductive fibers 52 to one surface of a belt-like cloth 53 and helically winding the cloth 53 around a rotary shaft 51 of a metal such as iron with a double-sided adhesive tape interposed. The fibers 52 are attached as piles to the cloth 53. In the case where the surface of the photosensitive drum 31 is electrically charged, the charging brush 34 is rotated together with the photosensitive drum 31, for example, in a direction opposite to the rotational direction of the photosensitive drum 31 at the same circumferential speed as that of the photosensitive drum 31.

However, the contact charging system using the charging brush 34 poses a problem as will be set out below. That is, since the charging brush 34 is so formed that the belt-like cloth with many fibers 52 attached thereto as shown in FIG. 2 is helically wound around the rotation shaft 51, a gap is created between each turn of the cloth 53. Further, even if the cloth 53 is so wound as to leave no gap between each turn, a helical gap (helical turn) is formed along a boundary of each turn because the fibers 52 are not attached to a full length from end to end in a width direction. When, as shown in FIG. 1, charging is made using the charging brush 34 of the above-mentioned structure, the fibers 52 is set in contact with part of the surface of the photosensitive drum 31 and not with the remaining part. Since charging is made in this manner, the amount of charge in the surface of the photosensitive drum 31 is not constant.

In the case where, therefore, a half-tone image is recorded on a recording sheet, there is a tendency that the density becomes higher at an area corresponding to the part not contacted with the fibers of the charging brush 34 and lower at the other area. This uneven density imparts a greater influence to an image quality and causes the deterioration of the image. Further, less area of the fibers 52 of the charging brush 34 is contacted with the surface of the photosensitive drum 31, thus leaving no contact between the surface of the photosensitive drum 31 and the fibers 52. This makes it difficult to uniformly charge the surface of the photosensitive drum 31, causing the surface potential to be irregular.

With the charging section using the conventional charging brush 34, it is not possible to constantly obtain a high quality image, thus presenting a problem to be solved.

BRIEF SUMMARY OF THE INVENTION

It is accordingly the object of the present invention to provide a charging device for electrophotography which can obtain an excellent image of a uniform density.

According to the present invention, there is provided a charging device for electrophotography, comprising a rotary charging member, having many fibers extending in radial around a rotation shaft and contacted with a surface of a photosensitive image carrier, for rotating to electrically charge the surface of the photosensitive image carrier with the fibers; and a charging control member located on a downstream side of a contact between the rotary charging member and the photosensitive image carrier in a rotation direction of the rotary charging member for temporarily retarding a movement of the fibers of the rotary charging member to increase an effective density of the fibers to be contacted with the surface of the photosensitive image carrier; wherein an end of the charging control member is at a distance of at least 1 mm from the contact between the rotary charging member and the photosensitive image carrier.

In the charging device for electrophotography, the rotation control member retards the movement of the fibers of the rotary charging member to increase the effective density of the fibers to be contacted with the photosensitive image carrier. Further, since the end of the charging control member is at a distance of at least 1 mm from the contact between the rotary charging member and the photosensitive image carrier, it is possible to reliably retard a movement of the fibers of the rotary charging member. For this reason, the limit of the charging characteristic of the rotary charging member is effectively overcome and it is possible to suppress the irregularity in charging to obtain an excellent image of a uniform density.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An electrophotographic apparatus according to one embodiment of the present invention will be described below with reference to the accompanying drawing.

Figure 4:
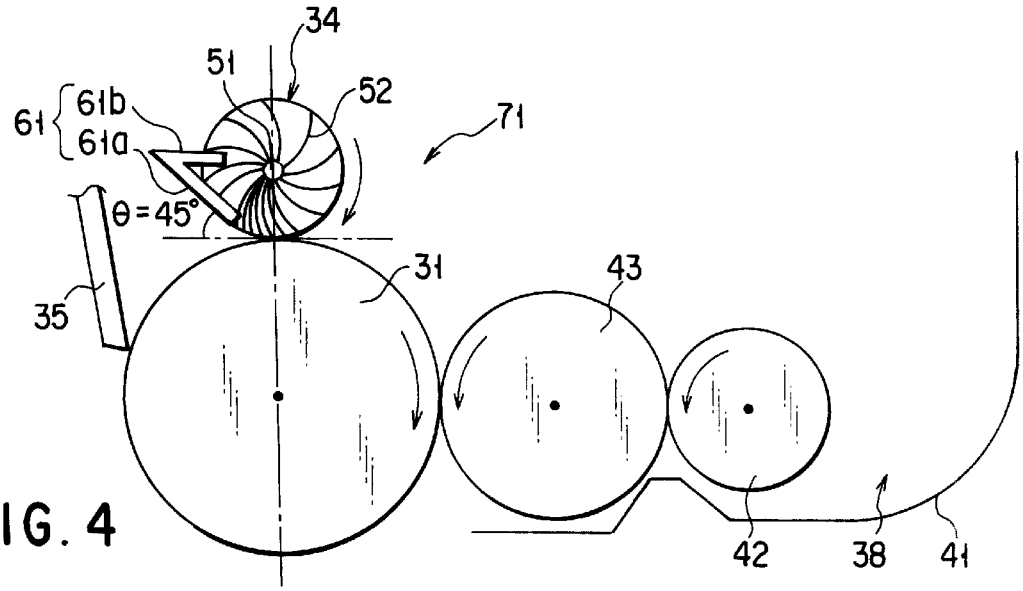
FIG. 4 is a view showing, in more detail, part of the electrophotographic apparatus shown in FIG. 3.
Figure 3:
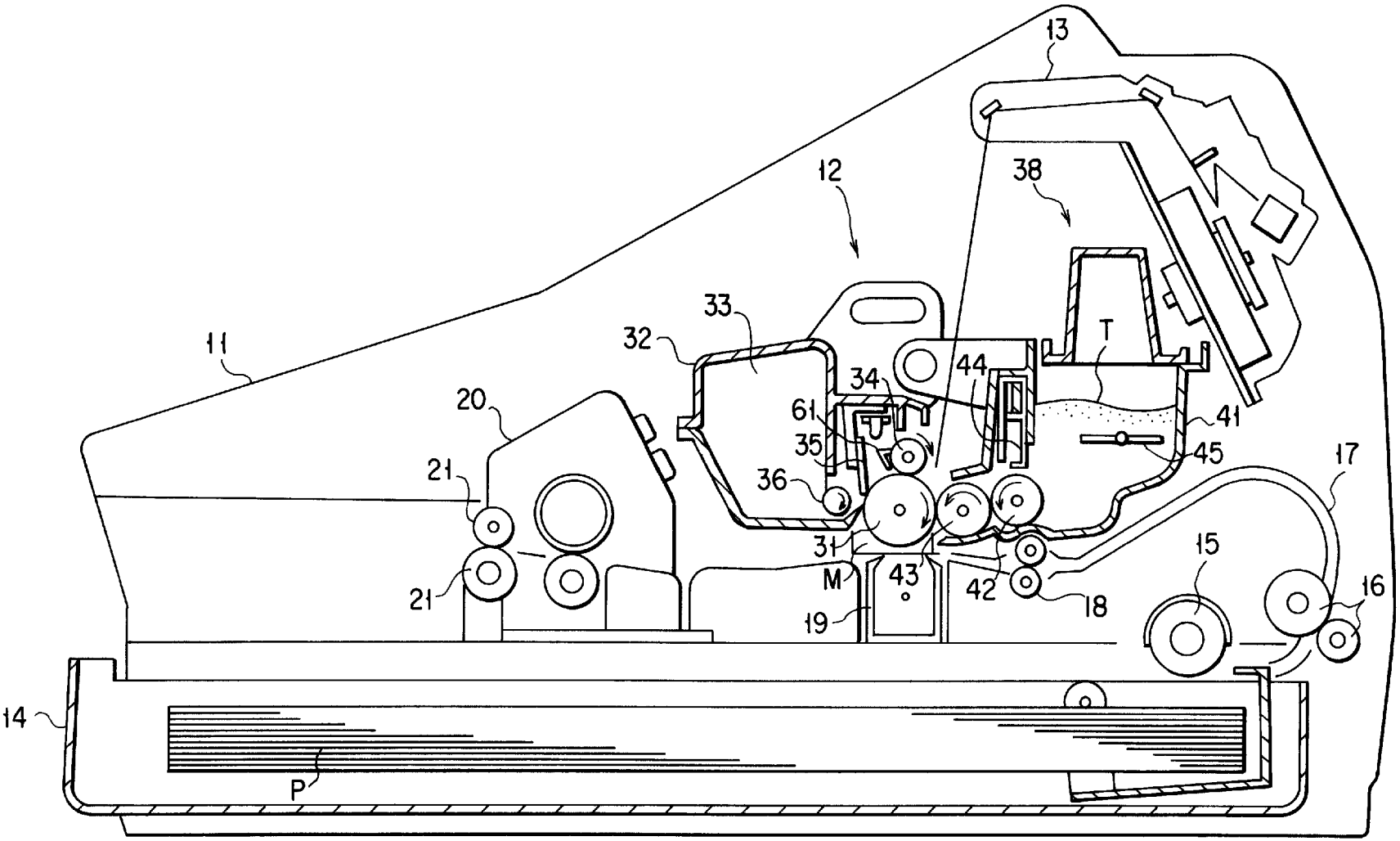
FIG. 3 is a view showing an internal structure of an electrophotographic apparatus according to one embodiment of the present invention.

FIG. 3 shows an internal structure of the electrophotographic apparatus, and FIG. 4 shows part of the electrophotographic apparatus in more detail. This electrophotographic apparatus is a laser printer including a housing 11, process unit 12, laser optical system 13, recording sheet cassette 14, pickup roller 15, feed roller 16, guide 17, feed roller 18, corona transfer device 19, heat fixing device 20 and discharge roller 21. The process unit 12 has a photosensitive image carrier and is detachably mounted at a internal center of the housing 11. The laser optical system 13 emits a laser beam to a charged-surface of the photosensitive image carrier to form an electrostatic latent image. A recording sheet cassette 14 is disposed below the process unit 12 within the housing 11 to hold a stack of recording sheets P. The pickup roller 15 picks up recording sheets P one by one from the recording sheet cassette 14. The feed roller 16 feeds the recording sheet P picked up by the pick-up roller 15. The guide 17 guides the recording sheet P from the feed roller 16 toward the process unit 12. The feed roller 18 feeds the guide sheet P guided by the guide 17 toward a photosensitive drum 31 of the process unit 12. The corona transfer device 19 is disposed below the photosensitive image carrier to face the image carrier. The heat transfer device 20 is located downstream of the process unit 12 in a recording sheet feeding direction. The discharge roller 21 discharges the recording sheet P passed through the heat fixing device 20.

The process unit 12 includes a photosensitive drum 31, case 32, waste toner receiving section 33, charging brush 34, cleaning blade 35, collection roller 36 and developing section 38 and is detachably mounted with respect to the housing 11. The case 32 receives therein the photosensitive drum 31, waste toner container 33, charging brush 34, cleaning blade 35, collection roller 36 and developing section 38. The photosensitive drum 31 serves as the photosensitive image carrier and is rotatably supported by the case 32 and rotated by a rotation drive mechanism M in a clockwise direction shown in FIG. 3. The charging brush 34 and charging control member 61 are disposed above the photosensitive drum 31 and serve as a charging section 71 for charging the surface of the photosensitive drum 31. The charging brush 34 is made of a roller-like brush member for contacting with the surface of the photosensitive drum 31 and is rotated by the rotation drive mechanism M together with the photosensitive drum 31. The charging control member 61 is located upstream of the charging brush 34 in a rotation direction of the photosensitive drum 31 and set to be in contact with the charging brush 34 for charging control. The cleaning blade 35 is located upstream of a charging section 71 in the rotation direction of the photosensitive drum 31 to remove the remaining toner on the surface of the photosensitive drum 31 as a waste toner. The collection roller 36 is disposed below the cleaning blade 35 to collect the waste toner removed from the surface of the photosensitive drum 31 by the cleaning blade 35. The waste toner container 33 is disposed to receive the waste toner collected by the collection roller 36.

In this electrophotographic apparatus, a developing section 38 is disposed on a side of the photosensitive drum 31 opposite to the waste toner container 33. The developing section 38 includes a toner hopper 41 for receiving a toner T, supply roller 42 supported by the toner hopper 41, developing roller 43, developing blade 44 and agitator 45. The supply roller 42 is rotated by the rotation drive mechanism M in a counter-clockwise direction to supply the toner from the toner hopper 41 to the developing roller 43. In order to develop an electrostatic latent image on the photosensitive drum 31 with the toner supplied from the supply roller 42, the developing roller 43 is rotated by the rotation drive mechanism M in the counter-clockwise direction in a state contacting with the photosensitive drum 31. The developing blade 44 is set in pressure contact with the developing roller 43 to regulate the thickness of the toner. The agitator 45 agitates the toner received in the toner hopper 41.

In the case where an image is printed by the above-mentioned electrophotographic apparatus on recording sheets P, each recording sheet P is picked up by the pickup roller 15 one by one from the cassette 14 and fed by the feed roller 16 along the guide 17. Further, the recording sheet P is fed by the feed roller 18 so as to pass through a position between the photosensitive drum 31 and the corona transfer device 19.

In the process unit 12, the photosensitive drum 31 is rotated by the rotation drive mechanism M at a circumferential speed of, for example, 80 mm/sec. The charging brush 34 is rotated by a rotation drive mechanism to uniformly charge the entire surface of the photosensitive drum 31 to, for example, −600V. Then, the laser optical system 13 selectively exposes the surface of the photosensitive drum 31 with a laser beam emitted on the basis of image information to discharge an area exposed by the laser beam to an electric potential of, for example, −50V, and form an electrostatic latent image on the photosensitive drum 31. Then, the developing section 38 supplies the toner to the surface of the photosensitive drum 31 to develop the electrostatic latent image into a toner image comprised of a toner selectively adhered to the photosensitive drum 31 by electrostatic attraction according to the electrostatic latent image.

In the developing section 38, the supply roller 42 is rotated to supply the toner T received in the toner hopper 41 to the surface of the developing roller 43. At this time, the toner T constitutes a layer of a uniform thickness regulated by the developing blade 44 on the developing roller 43 and is negatively charged by a friction between the supply roller 42 and the developing blade 44. The transfer device 19 transfers the toner image from the surface of the photosensitive drum 31 onto the recording sheet P passing through the position between the photosensitive drum 31 and the transfer device 19. After such transfer, the recording sheet P is fed through the heat transfer device 20 for fixing the transferred toner image and discharged to an outside of the housing 11 by the discharge roller 21.

Figure 1:
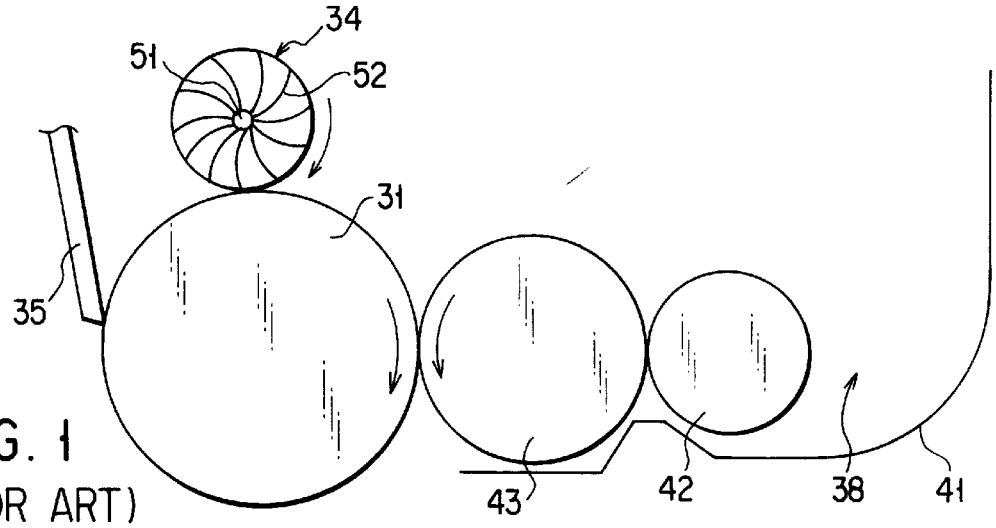
FIG. 1 (PRIOR ART)
FIG. 1 is a view showing a structure surrounding a photosensitive drum of a conventional electrophotographic apparatus.
Figure 2:
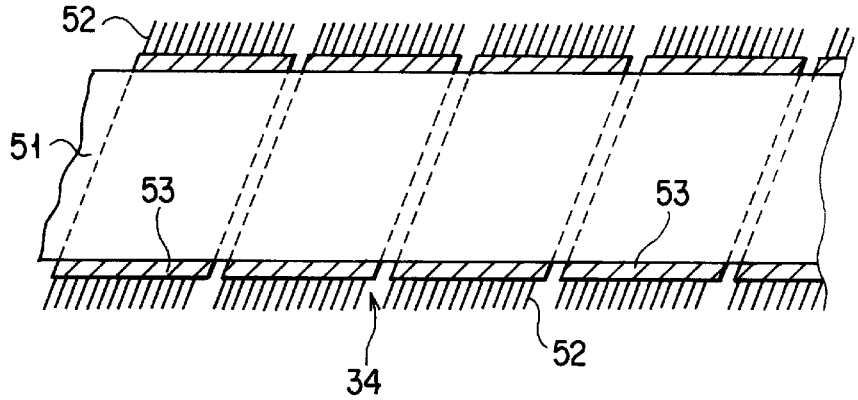
FIG. 2 (PRIOR ART)
FIG. 2 is a view showing a cross-sectional structure of a charging brush shown in FIG. 1.

Here, an explanation will be further made below about the charging section 71 of a contact charging type equipped with the charging brush 34 and charging control member 61. The charging brush 34 is rotatably supported by the case 32 at an upper side of the photosensitive drum 31 and disposed parallel to the shaft of the photosensitive drum 31. The diameter of the photosensitive drum 31 is set to be 30 mm, the diameter of the charging brush 34 is to be 16.6 mm smaller than that of the charging brush 34 and the span of the charging brush 34 is slightly longer than the width of the photosensitive drum 31. In the same manner as that of the conventional case shown in FIG. 2, the charging brush 34 is formed in a roller shape by attaching many conductive fibers 52 to one surface of a belt-like cloth 53 and helically winding the cloth 53 around a rotary shaft 51 of a metal such as iron with a double-sided adhesive tape interposed. The fibers 52 are attached as piles to the cloth 53 and have a length about 1 mm greater than a length required for setting the distal ends thereof to be contacted with the surface of the photosensitive drum 31. The charging brush 34 is rotatable by the rotation drive mechanism in a clockwise or counter-clockwise direction in a state that the fibers 52 are set in sliding contact with the surface of the photosensitive drum 31. A voltage of −1100V is applied as a bias voltage to the charging brush 34. That is, the charging brush 34 rotates to electrically charges the surface of the photosensitive drum 31 by the many fibers extending in radial and in contact with the photosensitive drum 31. If the charging brush 34 is rotated at the same circumferential speed as that of the photosensitive drum 31, then the charging brush 34 is rotated more times compared with the rotation of the photosensitive drum 31 since the brush 34 is smaller in diameter than that of the photosensitive drum 31. The surface of the photosensitive drum 31 is charged by electric charges discharged from the distal ends of the fibers 52 during the above-mentioned rotation. The distal ends of the fibers 52 are bent in various directions as if being bitten on the surface of the photosensitive drum 31 but, in general, the distal ends of the fibers 52 are bent along the rotation direction of the charging fibers 34 as shown in FIG. 4.

The charging control member 61 has a span slightly longer than the width of the photosensitive drum 31, and is set in parallel to the shaft of the charging brush 34 and located downstream of a contact between the charging brush 34 and the photosensitive drum 31 in the rotation direction of the charging brush 34. The charging control member 61 is formed with a use of an insulating material such as a dielectric resin so as to impart no adverse effect to an image formation process of forming an electrostatic latent image on the photosensitive drum 31 and developing the image with the conductive toner particles. In the case of, for example, using a mica as the dielectric resin, the elasticity of the mica absorbs an impact from the charging brush 34 which rotates in contact with the charging control member 61.

The charging control member 61 has a first control plate 61*a* and a second control plate 61*b* as shown in FIG. 4. The first control plate 61*a* is disposed downstream of the contact between the charging brush 34 and the photosensitive drum such that an end thereof is contacted with the fibers 52 of the charging brush 34 at a position close to the contact. With the rotation of the charging brush 34 the fibers 52 are brought into contacted with the control plate 61*a* after being contacted with the surface of the photosensitive drum 31.

Here, the control plate 61*a* temporarily retards the movement of the fibers 52 to allow the intervals of the fibers 52 to be narrowed at the distal ends thereof. This enhances the effective density of the fibers 52 near the surface of the photosensitive drum 31 and prolongs the state that the fibers 52 are kept in contact with the surface of the photosensitive drum 31. At this time, the helical gap is filled along a boundary of each turn of the cloth 53. After the temporary retardation, the fibers 52 are forced to be moved away from the control plate 61*a* toward the rotation direction of the charging brush 34.

That is, the fibers 52 of the charging brush 34 are uniformly contacted at a higher density with the surface of the photosensitive drum 31 to charge the surface of the photosensitive drum 31. Thus, the surface of the photosensitive drum 31 can be uniformly charged by the charging section 71 to obtain a toner image of a uniform density. As a result, an excellent image of uniform quality can be printed.

After such a temporary retardation, the fibers 52 of the charging brush 34 are moved with the rotation of a rotation shaft 51 toward the downstream side as if springing from the first control plate 61*a*. If, at this time, any deposit such as the toner particles and paper dust is present on the fibers 52, it is removed from the fibers 52 under an abrupt springing motion of the fibers 52. That is, the control plate 61*a* is also effective to remove away the deposit on the fibers 52 of the charging brush 34 which is attached upon contacting with the surface of the photosensitive drum 31. According to the present embodiment, the control plate 61*a* is mainly used for attaining a motion of enhancing a contact density between the fibers 52 of the charging brush 34 and the surface of the photosensitive drum 31 and secondary used for attaining a motion of removing away the deposit on the fibers 52.

In order to effectively enhance these motions, it is desirable that, the first control plate 61*a* be disposed in a downstream space of the photosensitive drum 31 in the rotation direction of the charging brush 34 and inclined to extend from a position flush with the rotation shaft 51 of the charging brush 34 toward a position close to the contact between the charging brush 34 and the photosensitive drum 31. By doing so, the fibers 52 of the charging brush 34 are readily liable to be contacted with the lower side end of the control plate 61*a* close to the photosensitive drum 31 after being contacted with the surface of the photosensitive drum 31. According to the present embodiment, the rotation shaft 51 of the charging brush 34 is located just above the rotation shaft of the photosensitive drum 31 and the contact between the fibers 52 and the photosensitive drum 31 is located on a vertical axis intersecting the rotation shaft 51 of the charging brush 34 and the rotation shaft of the photosensitive drum 31. In this embodiment, with the contact as a base point, the first control plate 61*a* is set upward at an inclination angle of 45° relative to a tangent of the photosensitive drum 31 passing through this base point, and the lower side end of the first control plate 61*a* is located at a position separated by at least 1 mm from the contact on a downstream side of the photosensitive drum 31 in the rotation direction of the charging brush 34.

Figure 5:
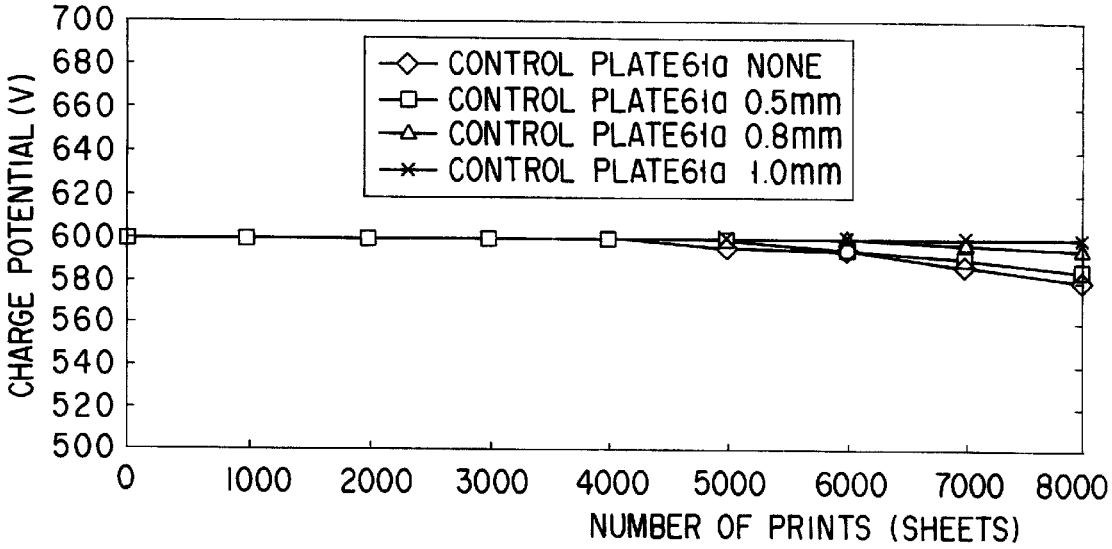
FIG. 5 is a graph showing a relation between a charging characteristic and a position of a first control plate shown in FIG. 4.

FIG. 5 shows a relation between the position of the first control plate 61*a* and the charge characteristic of the charging section 71. This charging characteristic is a result of experiments obtained in the case where there is no first control plate 61*a* and the lower side end of the first control plate 61*a* is spaced 0.5 mm, 0.8 mm and 1.0 mm from the contact. If the number of prints in total is about 4000 sheets, the charging characteristic is not deteriorated in any of these cases. When, on the other hand, the number of prints in total reaches 8000 sheets near to the service life (=10000 sheets) of the process unit 12, the charging characteristic is deteriorated except in the case where the distance between the lower side end of the first control plate 61*a* and the contact is over 1.0 mm. From this reason it is preferable that the lower side end of the first control plate 61*a* be set to a position separated by at least 1 mm from the contact.

The second control plate 61*b* is located on the downstream side of the control plate 61*a* in the rotation direction of the charging brush 34 in such a state as to be contacted with the fibers 52 of the charging brush 34. The fibers 52 pass through the control plate 61*a* with the rotation of the charging brush 34 and strike against the control plate 61*b* and move clear of the control plate 61*b* toward the downstream side. When the fibers 52 are moved clear of the control plate 61*a*, these fibers spring away from the control plate 61*a*. Even if, therefore, any deposit such as the toner particles and paper dust is present on the fibers 52, it is removed away from the fibers 52 under an abrupt motion of the fibers and downwardly flies away. Stated in more detail, the deposit such as the toner particles and paper dust is knocked off by the hitting of the fibers 52 against the control plate 61*b*. By doing so, the control plate 61*b* can more forcibly remove the deposit from the fibers 52 than the control plate 61*a*. Thus, the toner particles and paper dust, even if being deposited on the fibers 52 in contact with the photosensitive drum 31, these are immediately removed. For this reason, a resistance of the charging brush 34 is maintained to an initial set level without being increased due to the presence of the deposit. This can prevent the occurrence of a situation in which the surface potential of the photosensitive drum 31 is lowered due to an increase in the resistance of the charging brush 34 and the image density becomes higher than an initial level. In order to make this motion more effective, it is preferable that the second control plate 61*b* be made integral with the first control plate 61*a*, and project horizontally toward the rotation shaft 51 at the same height as that of the rotation shaft 51 of the charging brush 34 to overlap with the fibers 52 for 10 mm or more. In the present embodiment, the length between the upper side and lower side ends of the first control plate 61*a* is set to be 15 mm and the second control plate 61*b* is formed such that it is joined to an upper side end of the first control plate 61*a*.

Figure 6:
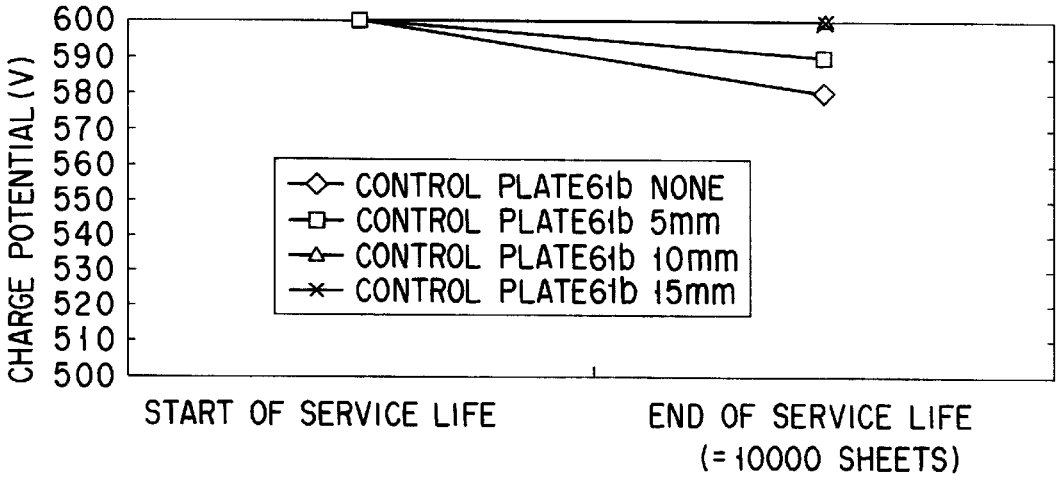
FIG. 6 is a graph showing a relation between a charging characteristic and a second control plate shown in FIG. 4.

FIG. 6 shows a relation between the position of the second control plate 61*b* and the charging characteristic of the charging section 71. This charging characteristic is a result of experiments obtained by setting the distance between the lower side end of the first control plate 61*a* and the contact to be 1.0 mm and in the case where there is no second control plate 61*b* and an overlap length between the second control plate 61*b* and the fibers 52 of the charging brush 34 is set to be 5 mm, 10 mm and 15 mm. When the number of prints in total reaches the service life (10000 sheets), the charging characteristic is deteriorated to a not-allowable extent in the case where the overlap length between the second control plate 61*b* and the fibers 52 of the charging brush 34 is less than 10 mm.

In the above-mentioned electrophotographic apparatus, the charging brush 34, while being rotated, is contacted by the control plate 61*a* with the surface of the photographic drum 31 at an adequately uniform density to allow the entire surface of the photosensitive drum 31 to be uniformly charged. Further, the deposit on the fibers 52 is removed at each rotation of the charging brush by the control plates 61*a* and 61*b* and it is possible to maintain the resistance of the charging brush 34 to an initial level. By the motion of the charging control member 61, an excellent image can be printed while maintaining the density of the image constant.

Further, the process unit 12 has therein not only the charging section 71 comprised of the charging brush 34 and charging control member 61 but also the photosensitive drum 31, case 32, cleaning blade 35, collection roller 36, developing section 38, etc., and is detachably mounted on the housing 11. Further, operability is not impaired to print an excellent image whose density is maintained to be constant.

The present invention is not restricted to the above-mentioned embodiments and can be variously modified without departing from the spirit and scope of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A charging device for electrophotography, comprising:

a rotary charging member having a plurality of fibers radially extending about a rotation shaft, the rotary charging member rotating about the rotation shaft such that the plurality of fibers contact a surface of a photosensitive image carrier to electrically charge the surface of said photosensitive image carrier; and a charging control member located on a downstream side of a contact between said rotary charging member and said photosensitive image carrier in a rotation direction of said rotary charging member for temporarily retarding a movement of the fibers of said rotary charging member;

wherein said charging control member includes a first control plate which is inclined and extends toward said contact and has an end whose position is separated by at least 1 mm from said contact and determined such that intervals of said fibers are narrowed to increase an effective density of said fibers near the surface of said photosensitive image carrier.

2. A charging device according to claim 1, wherein said charging control member is made of an insulating material.

3. A charging device according to claim 1, wherein said charging control member further includes a second control plate located on a downstream side of said first control plate in the rotation direction of said rotary charging member and which projects toward the rotation shaft of said rotary charging member, said second control plate overlapping with the fibers of said rotary charging member by at least 10 mm.

4. A charging device according to claim 3, wherein the first and second control plates are integrally formed with each other.

5. A charging device according to claim 3, wherein said first control plate is inclined from a position flush with the rotation shaft of said rotary charging member.

6. A charging device according to claim 1, wherein said first control plate is inclined from a position flush with the rotation shaft of said rotary charging member.

7. A charging device according to claim 1, wherein, with said contact as a base point, said first control plate is inclined at a predetermined angle relative to an axis perpendicular to an axis intersecting the rotation shaft of said rotary charging member and said contact.

8. An electrophotographic apparatus comprising:

a charging section for electrically charging a photosensitive image carrier;

an exposing section for selectively exposing the photosensitive image carrier to form an electrostatic latent image;

a developing section for developing the electrostatic latent image on said photosensitive image carrier as a toner image; and a transfer section for transferring the toner image from the photosensitive image to a recording sheet;

wherein said charging section includes:

a rotary charging member, having a plurality of fibers radially extending about a rotation shaft, the rotary charging member rotating about the rotation shaft such that the plurality of fibers contact a surface of said photosensitive image carrier to electrically charge the surface of said photosensitive image carrier; and a charging control member located on a downstream side of a contact between said rotary charging member and said photosensitive image carrier in a rotation direction of said rotary charging member for temporarily retarding a movement of the fibers of said rotary charging member;

wherein said charging control member includes a first control plate which is inclined and extends toward said contact and has an end whose position is separated by at least 1 mm from said contact and determined such that intervals of said fibers are narrowed to increase an effective density of said fibers near the surface of said photosensitive image carrier.

9. A charging device according to claim 8, wherein said charging control member further includes a second control plate located on a downstream side of said first control plate in the rotation direction of said rotary charging member and which projects toward the rotation shaft of said rotary charging member, said second control plate overlapping with the fibers of said rotary charging member by at least 10 mm.

10. A charging device according to claim 9, wherein the first and second control plates are integrally formed with each other.

11. A charging device according to claim 9, wherein said first control plate is inclined from a position flush with the rotation shaft of said rotary charging member.

12. A charging device according to claim 8, wherein with said contact as a base point, said first control plate is inclined at a predetermined angle relative to an axis perpendicular to an axis intersecting the rotation shaft of said rotary charging member and said contact.

13. A process unit adapted to be detachably mounted on an electrophotographic apparatus, comprising:

a photosensitive image carrier; and a charging section for electrically charging a photosensitive image carrier;

wherein said charging section includes:

a rotary charging member, having a plurality of fibers radially extending about a rotation shaft, the rotary charging member rotating about the rotation shaft such that the plurality of fibers contact a surface of said photosensitive image carrier to electrically charge the surface of said photosensitive image carrier; and a charging control member located on a downstream side of a contact between said rotary charging member and said photosensitive image carrier in a rotation direction of said rotary charging member for temporarily retarding a movement of the fibers of said rotary charging member wherein said charging control member includes a first control plate which is inclined and extends toward said contact and has an end whose position is separated by at least 1 mm from said contact and determined such that intervals of said fibers are narrowed to increase an effective density of said fibers near the surface of said Photosensitive image carrier.

14. A charging device according to claim 13, wherein said charging control member further includes a second control plate located on a downstream side of said first control plate in the rotation direction of said rotary charging member and which projects toward the rotation shaft of said rotary charging member, said second control plate overlapping with the fibers of said rotary charging member by at least 10 mm.

15. A charging device according to claim 14, wherein the first and second control plates are integrally formed with each other.

16. A charging device according to claim 14, wherein said first control plate is inclined from a position flush with the rotation shaft of said rotary charging member.

17. A charging device according to claim 13, wherein with said contact as a base point, said first control plate is inclined at a predetermined angle relative to an axis perpendicular to an axis intersecting the rotation shaft of said rotary charging member and said contact.

* * * * *